United States Patent [19]

McCabe

[11] 4,442,862

[45] * Apr. 17, 1984

[54] LINK BAR OPERATOR FOR ROTATING BLADE DAMPERS

[76] Inventor: Francis J. McCabe, 239 Hastings Ct., Doylestown, Pa. 18901

[ * ] Notice: The portion of the term of this patent subsequent to Jul. 13, 1999 has been disclaimed.

[21] Appl. No.: 267,334

[22] Filed: May 26, 1981

Related U.S. Application Data

[60] Continuation-in-part of Ser. No. 154,713, May 30, 1980, Pat. No. 4,338,967, which is a continuation-in-part of Ser. No. 16,514, Mar. 1, 1979, Pat. No. 4,301,569, which is a continuation-in-part of Ser. No. 896,299, Apr. 14, 1978, Pat. No. 4,195,384, which is a continuation-in-part of Ser. No. 799,044, Mar. 18, 1977, Pat. No. 4,099,292, which is a continuation of Ser. No. 676,483, Apr. 13, 1976, Pat. No. 4,041,570, and a continuation-in-part of Ser. No. 676,413, Apr. 13, 1976, Pat. No. 4,040,304, said Ser. No. 16,514, is a continuation-in-part of Ser. No. 764,774, Feb. 2, 1977, Pat. No. 4,114,646, which is a continuation of Ser. No. 689,994, May 26, 1976, Pat. No. 4,081,173, said Ser. No. 16,514, is a continuation-in-part of Ser. No. 896,237, Apr. 14, 1978, Pat. No. 4,219,041, said Ser. No. 16,514, is a continuation-in-part of Ser. No. 905,211, May 12, 1978, Pat. No. 4,183,129, which is a division of Ser. No. 729,813, Oct. 4, 1976, Pat. No. 4,113,232.

[51] Int. Cl.[3] ..... F24F 13/14; F16K 1/22

[52] U.S. Cl. ..... 137/601; 251/58; 251/280

[58] Field of Search ..... 137/601; 251/58, 138, 251/228, 279, 280, 294; 98/121 A; 49/73, 86

[56] References Cited

U.S. PATENT DOCUMENTS

| | | | |
|---|---|---|---|
| 1,487,861 | 3/1924 | Keenan | 49/86 |
| 1,573,930 | 7/1922 | Gilmore | 49/1 |
| 2,474,760 | 6/1949 | Smith | 49/2 |
| 2,581,321 | 1/1952 | Fletcher | 189/62 |
| 2,654,921 | 10/1953 | Blanchard . | |
| 2,759,573 | 8/1956 | Schwab | 189/62 |
| 2,803,319 | 8/1959 | Johnson | 49/1 |
| 2,827,259 | 3/1958 | Kindt | 251/228 X |
| 2,996,678 | 8/1961 | Brown . | |
| 3,062,232 | 11/1962 | McGay | 251/58 X |
| 3,084,715 | 4/1963 | Scharres | 137/601 |
| 3,182,951 | 5/1965 | Spencer | 251/280 X |
| 3,273,632 | 9/1966 | McCabe | 160/1 |
| 3,327,764 | 6/1967 | McCabe | 160/5 |
| 3,337,991 | 8/1967 | Adams | 98/86 |
| 3,426,507 | 2/1969 | Kossowski et al. | 55/129 |
| 3,447,443 | 6/1969 | Silvey | 98/110 |
| 3,510,101 | 5/1970 | Burtis | 251/280 X |
| 3,540,154 | 11/1970 | Claudio . | |
| 3,543,439 | 12/1970 | Pantland | 49/7 |

(List continued on next page.)

FOREIGN PATENT DOCUMENTS

| | | | |
|---|---|---|---|
| 1049654 | 1/1959 | Fed. Rep. of Germany | 251/138 |
| 1250224 | 9/1967 | Fed. Rep. of Germany | 251/294 |
| 1513298 | 1/1968 | France . | |
| 907 | of 1904 | United Kingdom . | |

*Primary Examiner*—Robert G. Nilson
*Attorney, Agent, or Firm*—Benasutti and Murray

[57] ABSTRACT

An operator for rotating blade dampers including a frame and a plurality of interconnected blades adapted for rotation within the frame, which operator comprises a pair of pivotally interconnected members operatively associated with the blades of the damper and the damper frame, and an actuator for causing articulation between the operator members, thereby rotating the damper blades between a fully open and a fully closed position. A variety of actuators may be used, including cable-type actuators as well as electrically and pneumatically operated actuators.

The operator is configured so that the amount of rotation of the damper blades which is caused by a given amount of operation of the actuator increases as the damper blades move toward the open position, and so that an over-center position is defined wherein the operator members are substantially longitudinally aligned and in which the blades of the damper are locked in position.

29 Claims, 13 Drawing Figures

U.S. PATENT DOCUMENTS

| | | | |
|---|---|---|---|
| 3,580,321 | 5/1971 | Root | 160/1 |
| 3,606,245 | 9/1971 | Reichow et al. | 251/306 |
| 3,718,081 | 2/1973 | Root | 98/110 |
| 3,725,972 | 4/1973 | McCabe | 160/48.5 |
| 3,727,663 | 4/1973 | McCabe | 160/84 R |
| 3,741,102 | 6/1973 | Kaiser | 98/110 |
| 3,796,248 | 3/1974 | McCabe | 160/1 |
| 3,814,165 | 6/1974 | McCabe | 160/207 |
| 3,866,656 | 2/1975 | McCabe | 160/84 |
| 3,889,314 | 6/1975 | McCabe | 16/48.5 |
| 3,899,156 | 8/1975 | McCabe | 251/303 |
| 3,908,529 | 9/1975 | McCabe | 98/110 |
| 3,955,792 | 5/1976 | Cho | 251/294 |
| 3,996,952 | 12/1976 | Root | 137/601 X |
| 4,040,304 | 8/1977 | McCabe | 74/230.1 T |
| 4,041,570 | 8/1977 | McCabe | 16/48.5 |
| 4,074,388 | 2/1978 | McCabe | 16/48.5 |
| 4,080,978 | 3/1978 | McCabe | 137/79 |
| 4,081,173 | 7/1978 | McCabe | 251/308 |
| 4,099,292 | 7/1978 | McCabe | 16/48.5 |
| 4,113,230 | 12/1978 | McCabe | 251/305 |
| 4,113,232 | 9/1978 | McCabe | 251/305 |
| 4,114,646 | 9/1978 | McCabe | 137/601 |
| 4,183,129 | 1/1980 | McCabe | 29/157 R |
| 4,185,657 | 1/1980 | McCabe | 137/601 |
| 4,185,658 | 1/1980 | McCabe | 137/601 |
| 4,219,185 | 8/1980 | McCabe | 251/308 |
| 4,277,870 | 7/1981 | McCabe | 29/157 R |
| 4,338,967 | 7/1982 | McCabe | 137/601 |

FIG. 1
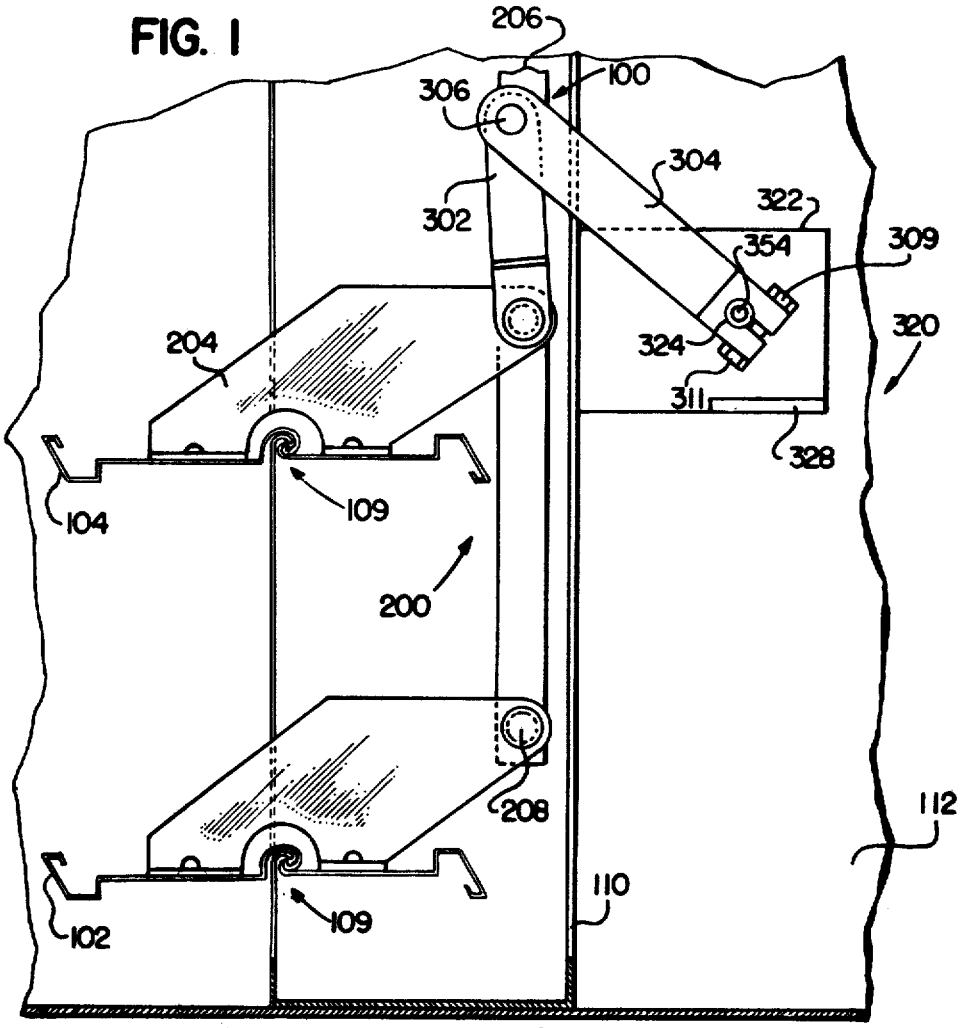
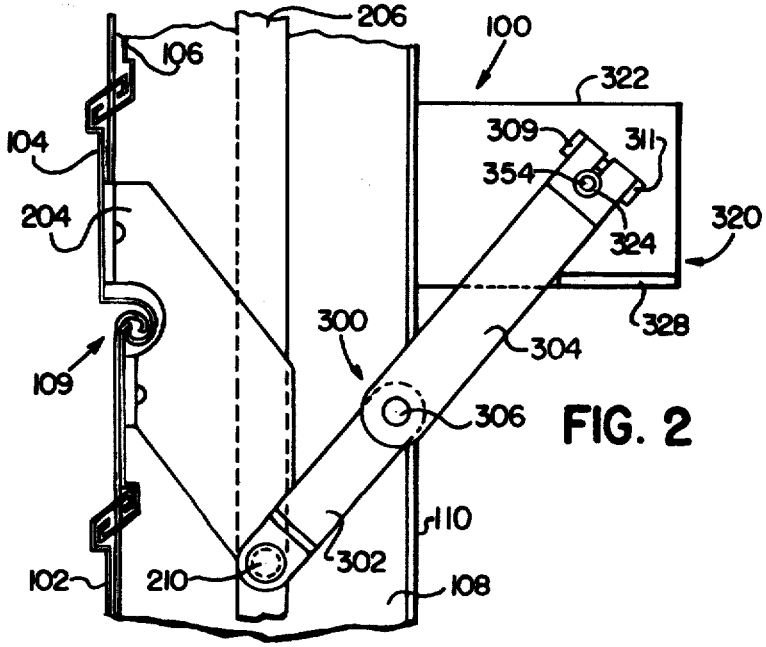
FIG. 2

LINK BAR OPERATOR FOR ROTATING BLADE DAMPERS

CROSS-REFERENCE TO RELATED APPLICATIONS

The present application is a continuation-in-part of my prior co-pending patent application Ser. No. 154,713, filed May 30, 1980, now U.S. Pat. No. 4,338,967, entitled "Universal Link Bar Operator For Rotating Blade Air, Smoke and Fire Dampers", the subject matter of which is incorporated by reference as if fully set forth herein.

U.S. patent application Ser. No. 154,713 is a continuation-in-part of application Ser. No. 16,514, filed Mar. 1, 1979, now U.S. Pat. No. 4,301,539, entitled "Quadrant Operator", which in turn was a continuation-in-part of application Ser. No. 896,299, filed Apr. 14, 1978, now U.S. Pat. No. 4,195,384, "Self-Resetting Cable Operated Translating Drive Link", now U.S. Pat. No. 4,195,384, dated Apr. 1, 1980; which in turn was a continuation-in-part of application Ser. No. 799,044, filed Mar. 18, 1977, entitled "Telescoping Heat Responsive Releasing Means", now U.S. Pat No. 4,099,292, dated July 11, 1978; which in turn was a continuation of application Ser. No. 676,483, filed Apr. 13, 1976, entitled "An Electrical Pneumatic Heat Actuated Fire Link Apparatus", now U.S. Pat. No. 4,041,570, dated Aug. 16, 1977, as well as a continuation-in-part of application Ser. No. 676,413 filed Apr. 13, 1976, entitled "Clutch Motor For Use In Resettable Fire Damper", now U.S. Pat. No. 4,040,304, dated Aug. 9, 1977. The subject matter of each of these applications is incorporated by reference as if fully set forth herein.

U.S. patent application Ser. No. 16,514 was also a continuation-in-part of application Ser. No. 764,774, filed Feb. 2, 1977, entitled "Rotating Blade Fire Damper", now U.S. Pat. No. 4,114,646, dated Sept. 19, 1978; which in turn was a continuation of application Ser. No. 689,994, filed May 26, 1976, entitled "Rotating Blade Fire Damper", now U.S. Pat. No. 4,081,173, dated Mar. 28, 1978. The subject matter of each of these applications is also incorporated by reference as if fully set forth herein.

U.S. patent application Ser. No. 16,514 was also a continuation-in-part of application Ser. No. 896,237, filed Apr. 14, 1978, entitled "Heat Responsive Locking Clip", now U.S. Pat. No. 4,219,041, dated Apr. 1, 1980, the subject matter of which is also incorporated by reference as if fully set forth herein.

U.S. patent application Ser. No. 16,514 was also a continuation-in-part of application Ser. No. 905,211, filed May 12, 1978, entitled "Smoke, Fire and Air Control Damper With Stamped Blade Hinge", now U.S. Pat. No. 4,183,129, dated Jan. 15, 1980; which in turn was a divisional of application Ser. No. 729,813, filed Oct. 4, 1976, entitled "Smoke, Fire And Air Control Damper With Stamped Blade", now U.S. Pat. No. 4,113,232, dated Sept. 12, 1978. The subject matter of each of these applications is also incorporated by reference as if fully set forth herein.

BACKGROUND OF THE INVENTION

The present invention relates generally to the construction of multi-blade air, smoke or fire dampers, and in particular, to mechanisms for rotating the damper blades to a desired orientation.

Generally, multi-blade dampers comprise a plurality of stamed blades pivoted for rotation within a damper frame. A common blade linkage is provided which causes simultaneous rotation of the damper blades between an open and a closed position in response to a particular condition. For example, maintaining the damper blades at a selected position intermediate the fully opened and closed positions provides an air control function. Maintaining the damper blades in either their fully closed or fully open position provides a fire or smoke control function. Examples of multi-blade dampers having such capabilities may be found in my U.S. Pat Nos. 4,113,230 and 4,113,232, both dated Sept. 12, 1978, the subject matter of each of which is incorporated by reference as if fully set forth herein.

A variety of mechanisms have been developed for operating the blade linkages which are used to cause articulation of the damper blades with respect to the damper frame. One such mechanism involves the use of a retractable cable in conjunction with an appropriate biasing means. The cable is generally attached to the blade brackets or blade linkages within the damper, and is then normally threaded through a ferrule disposed in the damper/duct wall for attachment to an actuator motor positioned outside of the duct in which the damper is located. A variety of means can be used to bias the blades toward a selected orientation, such as one or more springs extending between the damper frame and the blades. In this manner, a variety of functions may be developed. For example, selective retraction of the cable by the actuator motor will cause the damper blades to rotate to a desired orientation, against the force applied by the biasing device, providing an air control function. Providing a releasable means between the cable and the damper blades, such as a fusible link or the like, permits releasable engagement between the actuator motor and the damper blades which, depending upon the orientation of the biasing means, provides a fire or smoke control function. In fact, combinations of these functions may be developed, if desired.

Alternatively, it is known to operate such dampers using a shaft drive. Generally, rotation of the shaft drive through an arc of approximately 90° is caused to substantially correspond to the rotation of the damper blades approximately 90°, between their fully opened and closed positions. Various motorized actuators are known for use in rotating such operator shafts through their desired arc. One advantage provided by shaft-type operators is that they are advantageously controlled from a remote source, to adjust the flow of air through the damper by rotating the damper blades a preselected degree intermediate the fully opened or closed position. The use of shaft-type operators is also generally indicated when relatively large dampers must be operated, since shaft-type operators are generally required to deliver the amounts of power and torque necessary to properly operate such dampers, as opposed to the cable-type operators which generally can not.

While the use of shaft operated dampers may be preferred in certain instances, such operators often tend to exhibit a variety of disadvantages. For example, such operators are typically relatively difficult and expensive to install, primarily due to the fact that they are normally installed only after the damper has been installed within the duct. Such a requirement makes accurate installation difficult and expensive, and often results in improperly aligned damper/operator combinations. This is particularly so since such damper operators are often specifically designed for use with a particular damper type, promoting the potential for mismatching between these components during installation. For this reason, careful alignment procedures must be followed, generally requiring the use of highly skilled labor to obtain a proper installation.

As a further consideration, irrespective of the means used to rotate the damper blades, it is generally expected that there is a direct correspondence between the rotation of the damper blades and the percentage of air flow permitted to pass through the damper. For example, a 10° movement of the operator shaft, which substantially corresponds to 10° opening of the damper blades, is generally assumed to establish a corresponding air flow through the damper of approximately 10%. In actuality, particularly in conjunction with parallel blade-type dampers, it bas been found that the relationship between damper blade opening and the air flow through the damper is not linear. Rather, during the initial stages of damper blade opening, a correspondingly greater percentage volume of air has been found to pass through the damper for a given degree of blade rotation than during the final stages of damper blade opening. As the damper blades approach the fully opened position, a correspondingly smaller increase in air flow is achieved for a given degree of blade rotation.

Since parallel blade-type dampers generally cannot provide a linear relationship between the percentage flow of air through the damper and the degree of damper blade rotation, the use of opposed, rotating blade dampers is generally recommended when such linear air flow relationships are necessary. However, oposed blade dampers tend to produce other disadvantages which seriously limit their utility, particularly increased resistance to air flow.

It, therefore, remains desirable to develop a damper operator which overcomes the foregoing disadvantages without sacrificing proper operation of the damper structure used. It is particularly desirable to develop a damper operator which can be used to provide parallel blade-type dampers with linear air handling characteristics, and which permits cable-type actuator motors, as well as shaft-type actuator assemblies, to be used in conjunction with dampers of various sizes.

SUMMARY OF THE INVENTION

In accordance with the present invention, a damper operator is provided which generally comprises a pair of pivotally interconnected members; one associated with the blade linkage used to rotate the damper blades, and the other associated with the damper frame. In operation, the frame associated member traverses an arc of approximately 90° in order to cause rotation of the damper blades between their fully open and fully closed position, which provides compatability with a variety of conventional damper/actuator combinations.

For example, actuation of the operator may be accomplished using a jack shaft fixedly attached at a right angle to one end of the frame associated member, and extending transversely outwardly from the damper frame and through its associated duct for engagement by conventional actuation means. One such means which may be used for this purpose is an actuator plate which is fixedly attached at a right angle to the outer end of the jack shaft so that rotation of the actuator plate causes rotation of the jack shaft, and accordingly, the frame associated member of the damper operator. In this manner, associated movement of the link bar is provided which causes the blades to open and close as a unit. Biasing means associated with the actuator (or with the damper operator, if desired) can then be used to bias the damper blades toward a desired orientation. Varying the manner in which this biasing is overcome by operation of the actuator motor produces the desired air/fire/smoke control function desired.

A variety of conventional actuators may be used in conjunction with the damper operator of the present invention. For example, both electric and pneumatic actuators may be used to rotate the jack shaft previously described, and to maintain the damper blades in their desired orientation.

It is also possible to adapt the damper operator of the present invention for use with cable-type actuators, if desired. For example, the free end of the cable associated with the actuator motor may be attached to the actuator plate previously discussed, so that retraction of the cable will cause operation of the damper. Alternatively, this may be accomplished by attaching the free end of the cable near the interconnection between the two pivoally interconnected members comprising the damper operator, so that retraction of the cable causes articulation of the pivotally interconnected members, rotating the damper blades against an appropriate biasing means. In this configuration, the cable wound motor may be positioned either within the damper frame, or externally of the damper assembly.

It has been found that the damper operator of the present invention permits cable-type actuator motors to be used even with relatively large multi-blade dampers. By permitting such use of cable-type actuator motors, the damper operator of the present invention affords significant advantages over previously available operator assemblies. The greater mechanical advantage afforded by the damper operator of the present invention can even permit relatively small, commonly available, cable-type motors to be used in applications which involve relatively large damper constructions, without the attendant potential for strain or wear on gear trains, bent shafts, etc. Moreover, a greater degree of control is provided since cable-type motors are not restricted to 90° rotations, but can be rotated through a variety of angles, even in excess of 180°. As an added advantage, since the cable is flexible, overrun of the motor can occur without deleteriously affecting operation of the damper, reducing the amount of precision required to achieve proper damper control. Other benefits also result.

Irrespective of the type of actuator used, the damper operator of the present invention has been found to be particularly useful in providing air damper functions,, since the relative articulation between the interlocking members and the blade linkage has been found to provide an air flow characteristic which is substantially linear over its entire range, due to the interaction between these components. Accordingly, a substantially linear correspondence is provided between rotation of the damper operator and the amount of air permitted to pass through the damper.

Moreover, the damper operator of the present invention provides a knee-action locking capability which is capable of assuring that the blades of the damper can be maintained in a selected position, particularly a fully open or fully closed position, when the interconnecting members assume an "over-center" position in which they are in substantial longitudinal alignment with each other. For example, in the fully closed position, even in the presence of a fire, the damper operator of the present invention is capable of assuring that the damper blades remain securely closed. Similar advantages can be provided for use in smoke control applications.

Assembly of the damper operator of the present invention is straightforward. The free end of the articulated, interconnected members is attached to any of the damper blades, or the damper blade linkage. The length of the frame associated member is generally selected to calibrate the function of the damper blades in relation to the size of the damper. The "over-center" position which defines the knee-action locking capability of the damper operater establishes a limit in damper blade rotation which can be used to properly align the various elements comprising the damper so that the actuator plate, if used, and the actuator motor can then be appropriately connected to the damper operator, and attached to the damper frame/duct housing to complete the assembly.

Lastly, the damper operator of the present invention may optionally include a stop means capable of limiting movement of the damper blades beyond a selected, preset position in accordance with a particular ventilation requirement. This capability has been found to be particularily usefuly in air conditioning applications.

Accordingly, it is a primary object of the present invention to provide a simple and reliable link bar operator which is adaptable for use with a wide variety of rotating blade damper structures.

It is also an object of the present invention to provide a link bar operator for use with rotating, parallel blade dampers which provides linear variation between rotation of the damper operator and the amount of air delivered through the damper.

It is also an object of the present invention to provide a link bar operator for use with rotating blade dampers which can be effectively operated by a cable-type actuator motor.

It is also an object of the present invention to provide a link bar operator for use with rotating blade dampers which can effectively lock the blades of the damper in a desired orientation without assistance from the actuator motor.

It is also an object of the present invention to provide a link bar operator for use with the rotating blade dampers which permits simple installation of the damper, without requiring skilled labor or critical adjustment.

These and other objects of the present invention will become apparent from the following detailed description, taken in conunction with the following illustrations.

BRIEF DESCRIPTION OF THE DRAWINGS Sp

FIG. 1 ia a partial, cross-sectional view of a damper and damper operator produced in accordance with the present invention, located within a duct and in an open position.

FIG. 2 is a partial, cross-sectional view of the damper and damper operator shown in FIG. 1, with the damper and damper operator shown in the closed position.

In the several views provided, like reference numerals denote similar structures.

DETAILED DESCRIPTION OF THE PREFERRED EMBODIMENT

Figure 3:
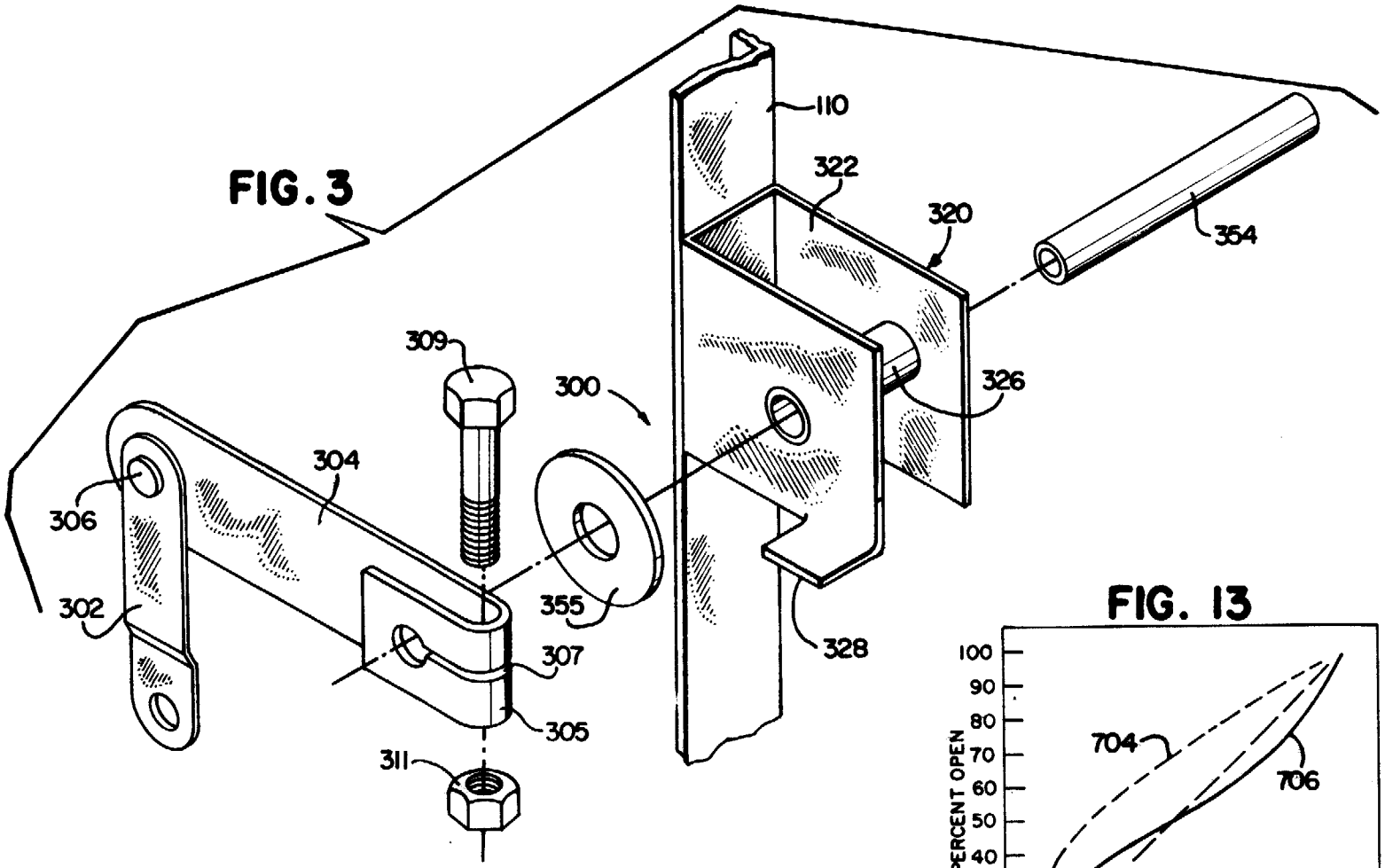
FIG. 3 is an exploded, isometric view of the damper operator shown in FIG. 1.

Although specific forms of the invention have been selected for illustration in the drawings, and the following description is drawn in specific terms for the purpose of describing these forms of the invention, this description is not intended to limit the scope of the invention which is defined in the appending claims.

The present invention generally comprises an operator for controlling an air, smoke or fire damper of the type which includes a frame and a plurality of interconnected blades adapted for rotation within the frame between a first, open position and a second, closed position with respect to the frame. The plurality of interconnected blades are pivotally attached to a link bar to form a parallel blade combination which acts to open and close the blades as a unit.

Such dampers are readily adapted to the performance of a variety of different functions. For example, by regulating the positioning of the blades intermediate the fully open and fully closed position, an air control function is provided which is well suited to ventillation applications. By causing and maintaining complete closure of the blades in response to an appropriate signal or stimulus, such as the detection of heat, the function of a fire damper is provided. By causing the blades to fully open in response to an appropriate signal or stimulus, such as an appropriate smoke detection device, the function of a smoke damper is provided. Combinations of these functions may also be developed, if desired. The following discusses examples of structure capable of performing the foregoing functions.

Referring now to the drawings, the use of a damper operator constructed in accordance with the present invention is shown in conjunction with a parallel, multiblade damper assembly, designated generally as 100. The damper assembly 100 generally includes a damper frame 108 having at least one inwardly depending frame flange 110, and a plurality of damper blades 102, 104, 106 pivotally disposed within the damper frame 108 about a plurality of hinge elements 109. For illustrative purposes, FIGS. 1 and 2 show the damper assembly 100 mounted within a duct 112. For additional details relating to the construction of such rotating blade damper assemblies, reference is made to the cross-referenced patents and patent applications, the disclosures of which have been incorporated by reference as if fully set forth herein. However, it is not intended to limit the present invention to use with such dampers, it being fully understood that the damper operator of the present invention can be used in conjunction with a variety of different damper constructions.

The damper assembly 100 also includes a linkage means 200 for articulating the blades with respect to the frame. This linkage means generally comprises a plurality of blade brackets 202, 204, a link bar 206, and link bar pivots 208, 210. Movement of the link bar 206 causes rotation about the pivots 208, 210 and their respective blade brackets 202, 204, causing the blades to move between their opened and closed positions, illustrated in FIGS. 1 and 2, respectively.

FIGS. 1, 2 and 3 illustrate a first alternative embodiment damper operator, designated generally as 300, which generally comprises a linkage associated operator member 302 and a frame associated operator member 304 which are pivotally interconnected by an operator pivot 306 to form a knee-action joint. The linkage associated operator member 302 is pivotally attached to the link bar 206, preferably at one of the link bar pivots 210, and is provided with an offset 211 to accommodate the frame associated operator member 304 during articulation of the assembly. The frame associated operator member 304 terminates at a clamp means 305 which includes a slotted aperture 307 capable of engaging the end of a jack shaft 354 as shown. Frictional engagement between the shaft 354 and the slotted aperture 307 of the clamp means 305 is provided by extending a nut 309 and bolt 311 transversely through the clamp means 305, and then tightening the nut and bolt to close the slotted aperture 307 over the shaft 354. The shaft 354 is pivotally associated within the damper frame 108 by mounting means 320, which generally comprises a U-shaped mounting bracket 322 connected to the framed flange 110 and including a bushing 324 located within the mounting bracket 322 to define a means for receiving the shaft 354.

Figure 14:
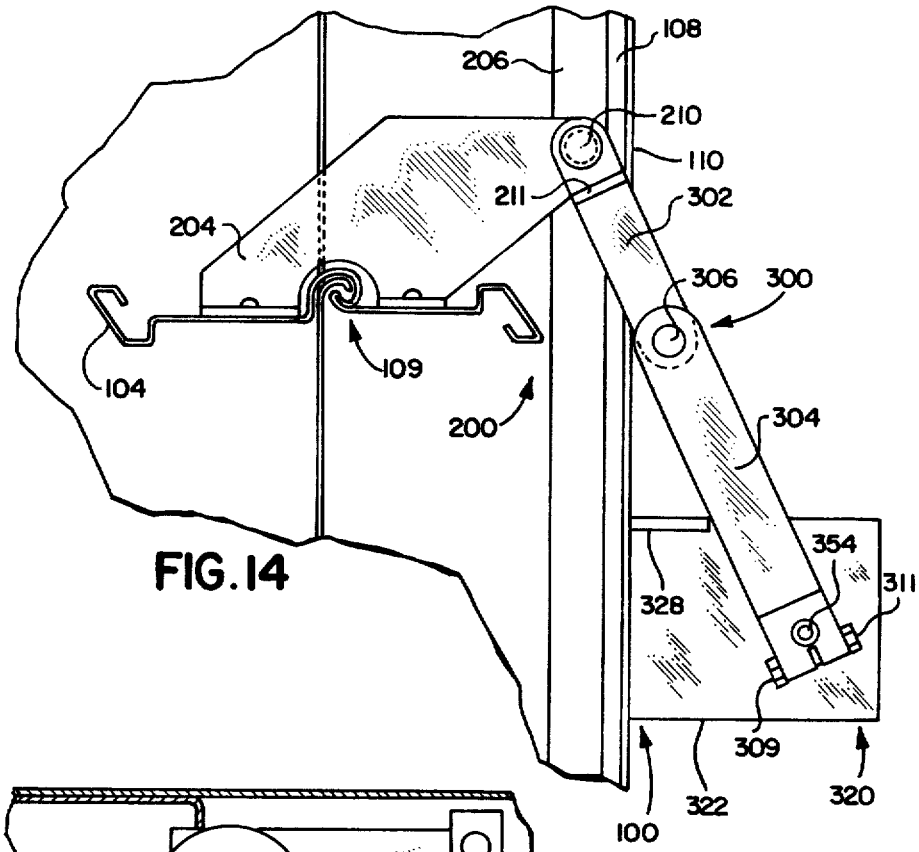
FIG. 14 is a partial, cross-sectional view of a damper and damper operator similar to those illustrated in FIG. 2, with the damper and damper operator shown in the open position.

Lastly, an integral stop means 328 is provided for limiting rotation of the frame associated member 304, preferably at a position which corresponds to an over-center position in which the operator pivot 306 is in substantial alignment with an imaginary line connecting the link bar pivot 210 asociated with the linkage associated operator member 302 and the shaft 354 associated with the frame mounting bracket 322. At this over-center position, the knee-joint is effectively locked, which, with reference to FIG. 2, enables the joint to effectively resist forces tending to open the damper blades, such as may result during a fire. Reference is also made to FIG. 14, which illustrates locking of the knee-joint to effectively resist forces tending to close the damper blades, if desired in a particular application.

To provide an assembled damper installation, the shaft 354 of the damper operator 300 is extended through the bushing 324, and the washer 355. One end of the shaft 354 is engaged by the clamp means 305 as previously described while the remaining end of the shaft 354 is caused to extend through the duct wall 112 for connection to an externally mounted actuation means 500. A variety of different types of actuation means may be used for this purpose, and although the use of several different types of actuators are described below, the use of still other types of actuators is also possible.

Figure 4:
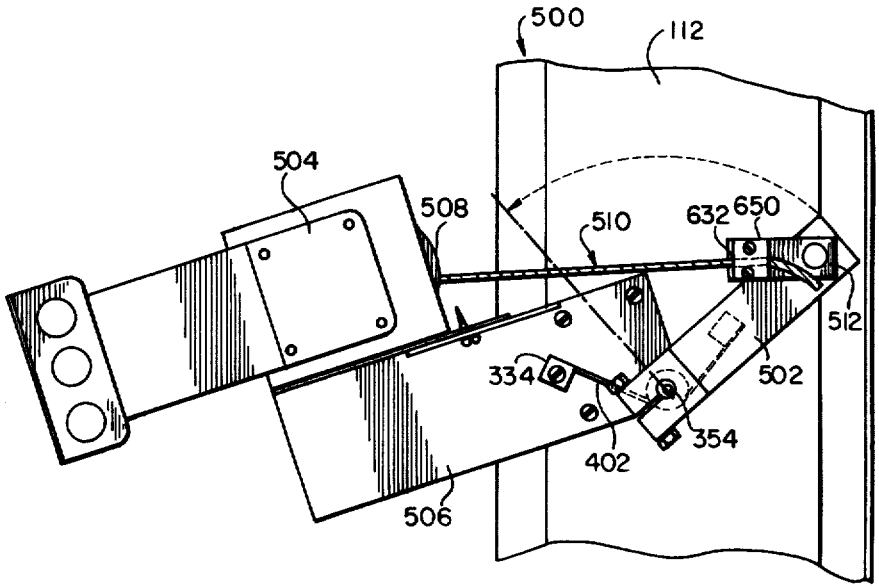
FIG. 4 is a partial, side elevational view showing use of an actuator with the damper and damper operator shown in FIG. 1.
Figure 5:
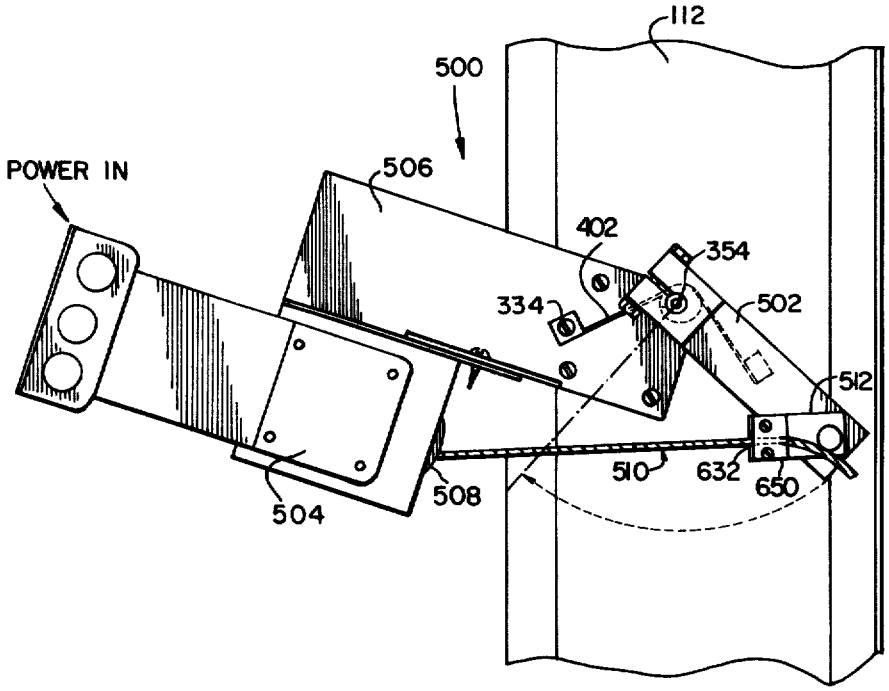
FIG. 5 is a partial, side elevational view showing use of the actuator shown in FIG. 4 in an alternative configuration.

Referring now to FIGS. 4 and 5, a first alternative actuation means is shown which makes use of a cable operated drive motor 504 to provide both power open/-spring closed operation (for air or fire control) or power closed/spring open operation (for air or smoke control), respectively. In either case, the drive motor 504 is positioned on a mounting plate 506 which is attached to the duct wall 112 using appropriate hardware, and which properly positions the motor with respect to the remainder of the assembly. Fixedly attached to the shaft of the motor 504 is a pulley 508 which engages one end of an actuator cable 510. The other end of the cable 510 is pivotally attached to an actuator plate 502, which is in turn attached to the exposed end of the shaft 354 of the damper operator 300, so that rotation of the actuator plate 502 causes rotation of the shaft 354. Additionally, a spring 402 is provided which properly biases movement of the damper operator, and the damper blades, as will be more fully described hereinafter. As shown, the spring 402 is advantageously positioned around the shaft 354 so that the ends of the spring 402 may be attached to the mounting plate 506 and the actuator plate 502 using any of a variety of attachment means, such as the pressure plates 334 illustrated. Other installations are also possible. The assembly comprising the drive motor 504, the actuator plate 502 and the spring 402 combines to provide a variety of different damper functions.

For example, the damper 100 and damper operator 300 of the present invention may be used to provide an air control function by positioning the spring 402 so that the damper blades are biased toward either a fully open or fully closed position, and by attaching the cable 510 to the actuator plate 502 so that retraction of the cable 510 by the motor 504 will overcome the biasing forces applied by the spring 402. Retraction of the cable 510 will thereby cause the damper blades to open to a desired degree, by overcoming these biasing forces, through rotation of the shaft 354 and the corresponding articulation of the members 302, 304 between the positions illustrated in FIGS. 1 and 2.

In many air control applications, it is desirable to assure that some minimum amount of air flow is maintained through the damper at all times. To allow this minimum air flow to be established, and varied to suit a variety of applications, the adjustment means 630 may be provided. Adjustment means 630 generally comprises a bracket 632 which is pivotally associated with the actuator plate 502, and a pressure plate 650 which is attached to the bracket 632, using appropriate hardware, so that the free end of the cable 510 is clamped between the bracket 532 and the pressure plate 650. By varying the length of the cable 510 (by varying the location where the adjustment means 630 engages the free end of the cable 510) the permissible extension of the actuator plate 502 is varied so that the desired minimum air flow is established through the damper during its operation.

Figure 11:
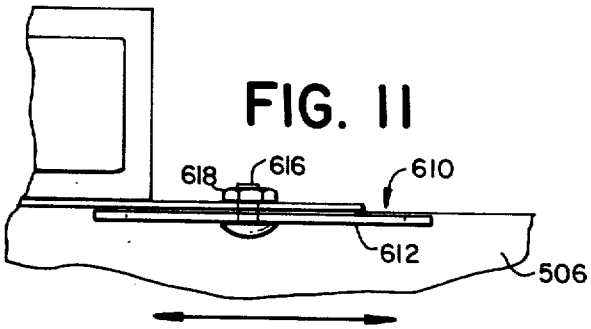
FIG. 11 is a partial, top plan view of a stop means for use with the damper operator of the present invention.
Figure 12:
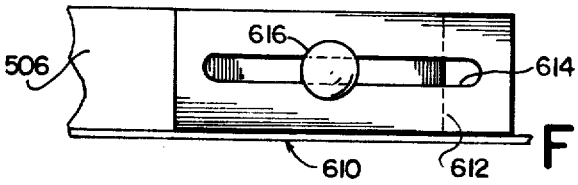
FIG. 12 is a partial, side elevational view of the stop means shown in FIG. 11.

An alternative means for limiting the travel of the actuator plate 502 is illustrated in detail in FIGS. 11 and 12. As shown, the mounting plate 506 is provided with an appending bracket capable of engaging an adjustable retaining plate 610. Adjustment is performed by sliding the plate 610 along the appending bracket forming part of the mounting plate 506 so that travel of the actuator plate 502 is limited to the extent desired. To provide this capability, the plate 610 includes an adjustment slot 614, and a threaded stud 616 and tightening nut 618 are extended through the slot 614 and the appending bracket of the mounting plate 506 as shown. After setting the plate 610 in its desired position, the stud 616 and nut 618 are tightened, maintaining the selected adjustment.

Each of the adjustment means previously described may also be used to establish selected maximum air flows through the damper structure, if desired, provided appropriate alterations are made to the structural interrelationships established between the various elements comprising the damper 100, the damper operator 300, and the actuator motor 504. Moreover, combinations of the foregoing air flow regulation devices may be used if indicated for a particular application.

In addition to providing an air control function, the damper 100 and damper operator 300 of the present invention may also be used to provide a fire or smoke control function, if desired. In so doing, the drive motor 504 is preferably maintained in a normally "off" condition, with the spring 402 relaxed, so that the blades of the damper are maintained in a normal operating position, either fully open or fully closed, as indicated for a particular application. When a fire actuated condition is sensed, using any of a variety of sensors located within the duct, or by using a remote fire or smoke detector, the motor 504 is caused to operate, causing the pulley 508 to rotate and retract the cable 510. In turn, this causes rotation of the actuator 502 and shaft 354 so that the members 302, 304 begin to articulate and so that the biasing spring 402 is compressed. The motor 504 is preferably a stall type motor, so that rotation of the motor 504 will stop when the stop means 328 is contacted, thereby limiting further rotation of frame associated member 304. At this point, the knee-action joint of the damper operator 300 assumes its over-center locked position. The articulated members 302, 304 will remain in this locked position as long as the sensed condition persists.

After the sensed condition ceases, operation of the motor 504 is discontinued, thereby releasing the motor shaft so that the pulley 508 can rotate freely under the stimulus of the compressed spring 402. This unlocks the knee-joint and allows the blades to return to their normal operating position.

The foregoing requires operation of the actuator motor to move the damper blades to a desired position. However, by reversing the biasing of the spring 402, and the orientation of the actuator motor, it is also possible for the motor to assume its "off" condition when damper operation is desired, so that only the biasing forces produced by the spring 402 are needed to cause damper operation, rather than operation of the actuator motor. This results in a passive system which does not require the application of power to the assembly during the actual occurrance of a sensed event, but only requires power to return the damper blades to their normal position.

Figure 6:
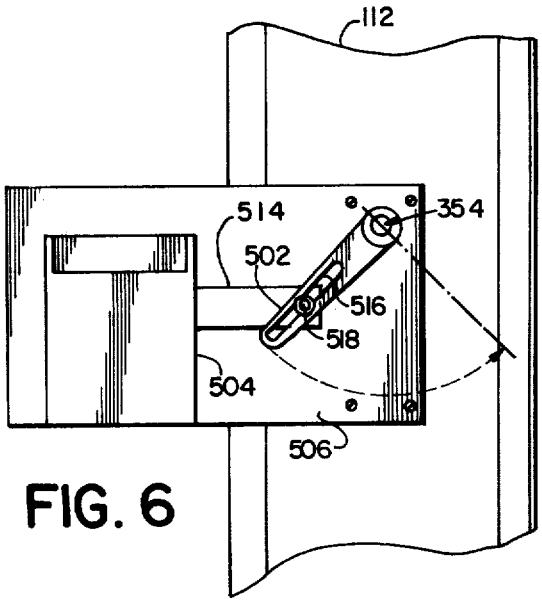
FIGS. 6 and 7 are partial, side elevatonal views similar to those of FIGS. 4 and 5, but showing an alternative embodiment actuator.
Figure 7:
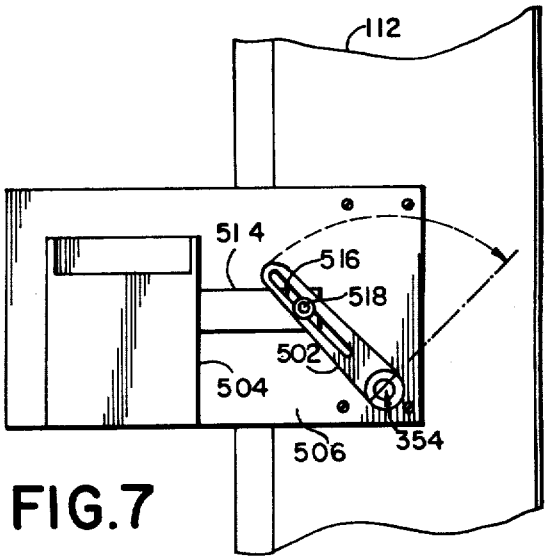
Figure 9:
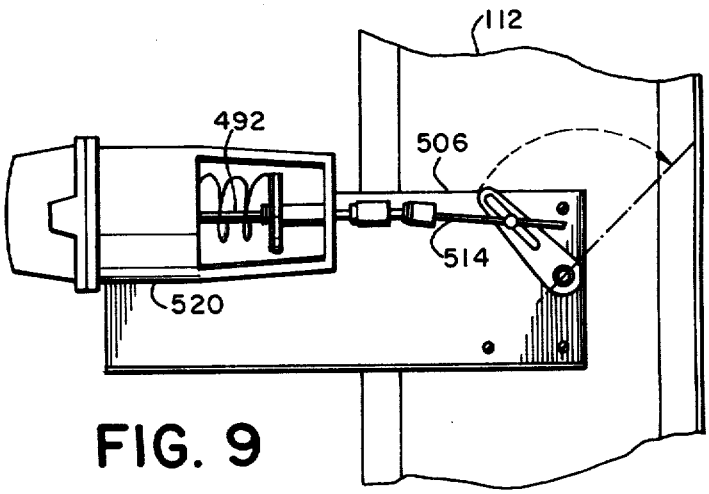
FIGS. 8 and 9 are partial, side elevational views similar to those of FIGS. 4 and 5, but showing an alternative embodiment actuator.
Figure 8:
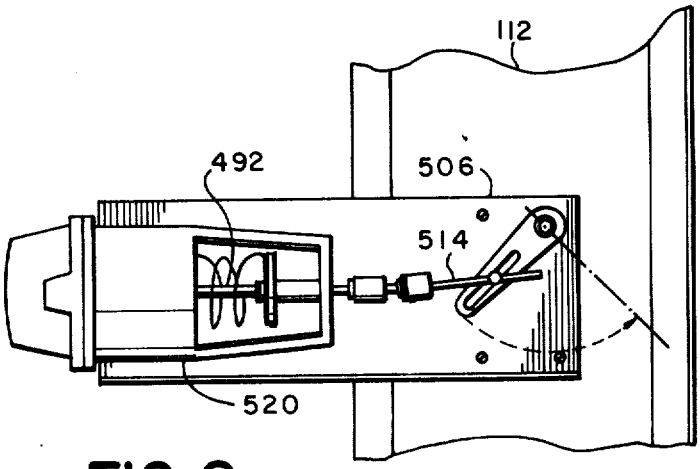

Alternative actuator motors may also be used to provide these functions, as illustrated in FIGS. 6–9. In FIGS. 6 and 7, the cable 510 has been replaced with a rigid oscillator arm 514 which slideably engages a slot 516 provided in the actuator arm 502. Operation of the motor 504 causes reciprocal movement of the arm 514, which serves to operate the damper 100 in the same manner as previously described. In FIGS. 8 and 9, the motor 504 has been replaced with a pneumatic cylinder 518. As shown, a biasing spring 492 is mounted within the cylinder housing, eliminating the need for the spring 402 previously described.

The foregoing discusses various shaft operated damper/damper operator assemblies. However, the damper/damper operator of the present invention is also ideally suited for use in conjunction with other types of operator assemblies, if desired. For example, reference is made to the alternative embodiment illustrated in FIG. 10. As shown, the linkage associated operator member 302 is connected to the link bar pivot 210 and the frame associated operator member 304 is pivotally connected to the frame mounting bracket 322 by the shaft 354, as previously described. Again, a stop means 328 is provided which defines the over-center, locked position of the frame associated member 304, thereby regulating operation of the knee-action joint in the manner previously described. However, in this embodiment, the spring 402 now extends around the shaft 354 so that one end engages the stop means 328 and the other end engages an offset slot provided in the frame associated operator member 304; and a cable-type actuator means is provided for causing articulation between the operator members 302, 304 as follows.

Figure 10:
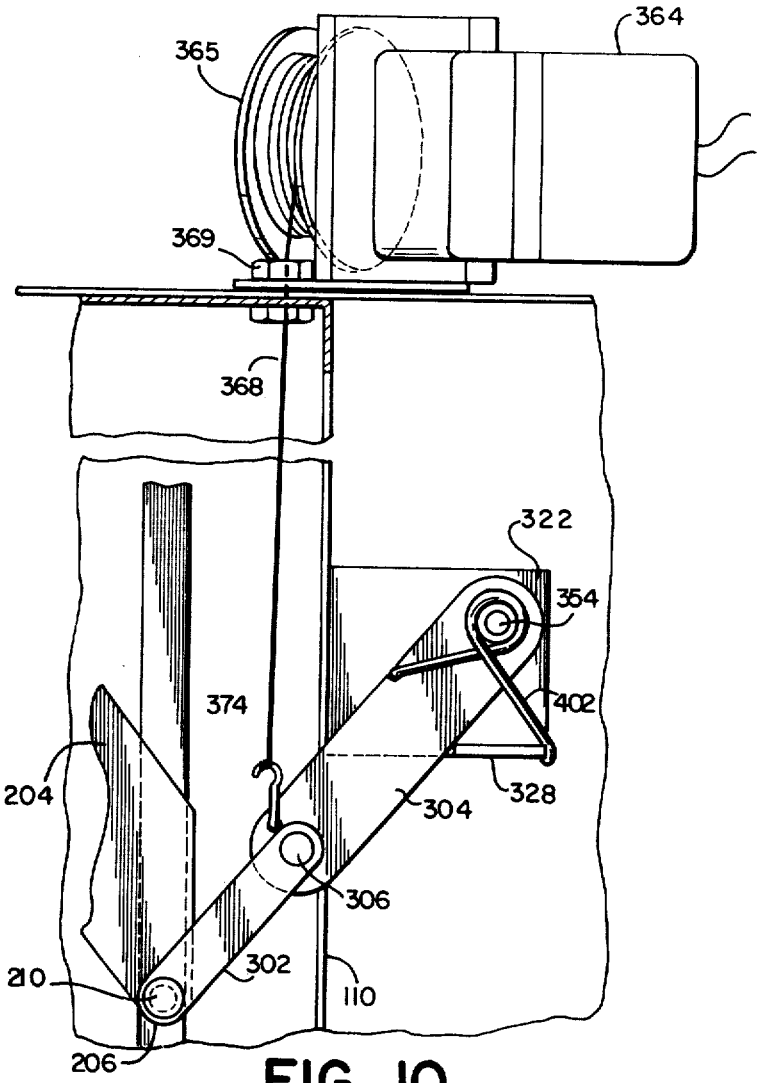
FIG. 10 is a partial, cross-sectional view showing use of a damper operator produced in accordance with the present invention with a cable actuator.
Figure 15:
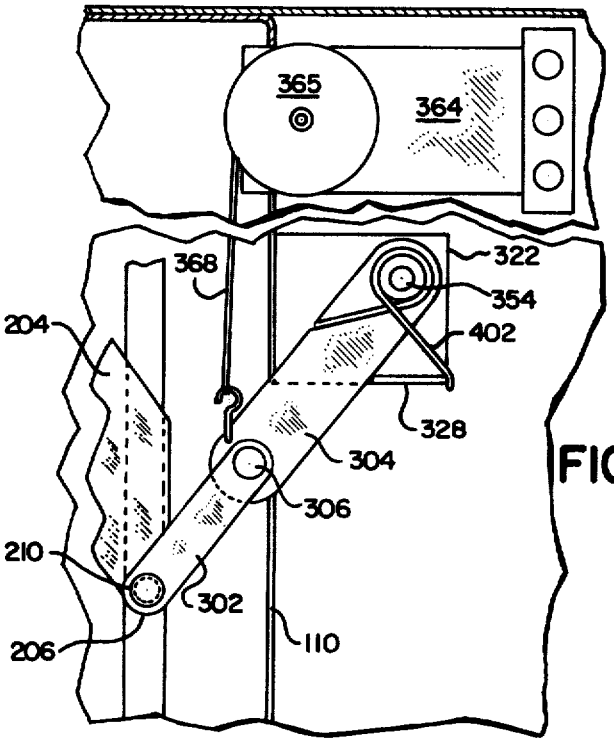
FIG. 15 is a partial, cross-sectional view showing use of a damper operator produced in accordance with the present invention with an alternative embodiment cable actuator.

As shown in FIG. 10, the cable-type actuator means generally comprises a motor 364 having a pulley 365 operatively associated therewith. The pulley 365 engages a cable 368 which is threaded through a ferrule 369 for connection to one of the operator members, preferably the frame associated operator member 304, in the vicinity of the operator pivot 306. If indicated for a particular application, it is also possible to locate the motor 364 and pulley 365 within the damper assembly, as illustrated in FIG. 15, eliminating the need to thread the cable 368 through a ferrule and providing a fully contained means for operating the damper assembly. Irrespective of the embodiment used, retraction of the cable 368 by the motor 364 and pulley 365 causes articulation between the members 302, 304, which in turn causes the damper blades to move between their fully open and fully closed position. In this manner, the foregoing assembly can be used to provide all of the damper functions previously described, by properly regulating retraction of the cable 368. Fire and smoke damper functions can also be obtained by utilizing appropriate releasing means in conjunction with the foregoing structure which is capable of releasing the damper blades for rotation to a preselected orientation under the influence of the spring 402. One example of this involves the placement of a fusible link in series with the cable 368, so that separation of the link will permit the damper blades to close under the influence of the spring 402. Other means for providing this function are also possible.

Figure 13:
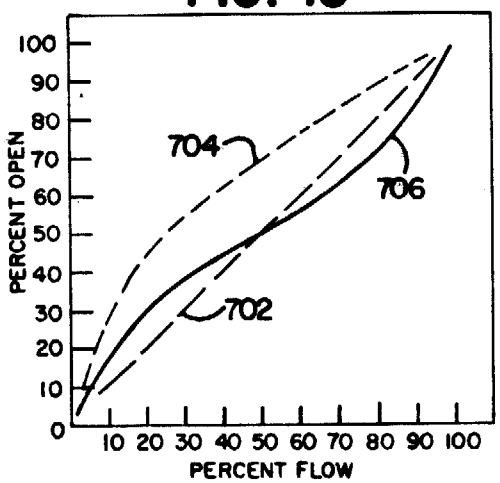
FIG. 13 is a graph illustrating variations in air flow through the damper in relation to operator rotation.

Irrespective of which of the foregoing actuation devices are used, the damper operator of the present invention is capable of providing improved air flow characteristics through the damper due to those structural interrelationships established between the various elements comprising the damper operator 300 which, during initial opening of the damper, cause relatively less blade rotation to occur for a given amount of operator shaft rotaion. This phenomenon is believed to result from the geometric relationships developed between the paths of initial movement of the operator members 302, 304 and the linkage rod 206. It has been found that the arcuate paths defined by the linkage rod pivot 210 and the operator pivot 306 converge as the blades of the damper approach their fully opened position. Accordingly, at the beginning of the opening cycle, a given degree of actuation will produce relatively less rotation of the damper blades than at the end of the opening cycle, when the arcs defined by the linkage rod pivot and the operator pivot are substantially coincident. By appropriately regulating these features, operator rotation can be caused to correspond, in a substantially linear fashion, to the amount of air flow permitted to pass through the damper. FIG. 13 represents a graph which illustrates this phenomenon. In this graph, the amount of air flow permitted to pass though the damper is measured in relation to operator shaft rotation. Reference curve 702 illustrates an ideal, linear relation between these parameters, while curve 704 shows a typical relationship established between these parameters using previously available damper operators. Curve 706 illustrates the characteristics exhibited by the damper operator of the present invention, which may be seen to substantially approximate a linear flow variation.

It will be understood that various changes in the details, materials and arrangement of parts which have been herein described and illustrated in order to explain the nature of this invention may be made by those skilled in the art within the principle and scope of the invention as expressed in the following claims.

What is claimed is:

1. An operator for operating a damper having a frame and at least one blade adapted for rotation within the frame between an open position and a closed position, wherein said operator comprises:

(a) at least two, pivotally interconnected operator members, a first operator member being operatively associated with the frame of the damper and a second operator member being operatively associated with the damper blade; and (b) acutator means operatively associated with at least one of the two operator members;

wherein operation of the actuator means causes articulation of the operator members, which in turn causes rotation of the damper blade, so that the amount of rotation of the damper blade which is caused by a given amount of operation of the actuator means increases as the damper blade moves toward the open position, and so that changes in air flow through the damper essentially directly relate to a given amount of operation of the actuator means.

2. The operator of claim 1 wherein the actuator means is cable operated.

3. The operator of claim 2 wherein the actuator means comprises an actuator plate, one end of which is engaged by an end of a reciprocatable cable and the other end of which is engaged by a shaft operatively associated with the first operator member.

4. The operator of claim 3 wherein the actuator means further comprises biasing means operatively associated therewith.

5. The operator of claim 3 wherein the actuator means further comprises means for limiting rotation of the damper blade within the frame, thereby establishing a minimum or maximum air flow therethrough.

6. The operator of claim 5 wherein the limiting means comprises a bracket pivotally associated with the actuator plate and a bearing plate connected to the bracket so that the end of the cable is engaged between the bracket and the bearing plate.

7. The operator of claim 5 wherein the limiting means comprises a bracket associated with the actuator means and an adjustable plate which variably engages the bracket.

8. The operator of claim 2 wherein the actuator means comprises:

(a) a pulley operatively associated with a motor;

(b) a cable, a first end of which is attached to the pulley so that the cable will become wound around the pulley in response to operation of the motor and a second end of which is attached to one end of the operator members in the vicinity of the pivotal interconnection.

9. The operator of claim 8 wherein the actuator means further comprises biasing means operatively associated therewith.

10. The operator of claim 8 wherein the motor, pulley and cable are each located within the frame of the damper.

11. The operator of claim 8 wherein the motor and pulley are located externally of the frame of the damper, and the cable is threaded through a ferrule which communicates with the interior of the frame of the damper.

12. The operator of claim 1 wherein the actuator means is an electrically operated motor.

13. The operator of claim 1 wherein the actuator means is a pneumatically operated motor.

14. The operator of claim 12 or 13 wherein the actuator means further comprises an actuator plate, one end of which is engaged by a shaft operatively associated with the first operator member, and having a longitudinal slot capable of receiving a pivotal connection therein, which pivotal connection is operatively associated with the motor.

15. The operator of claim 14 wherein the actuator means further comprises means for limiting rotation of the damper blade within the frame, thereby establishing a minimum or maximum air flow therethrough.

16. The operator of claim 15 to wherein the limiting means comprises a bracket pivotally associated with the actuator plate and a bearing plate connected to the bracket so that the second end of the cable is engaged between the bracket and the bearing plate.

17. The operator of claim 15 wherein the limiting means comprises a bracket associated with the actuator means and an adjustable plate which variably engages the bracket.

18. The operator of claim 1 wherein the operator further comprises stop means for limiting articulation between the operator members.

19. The operator of claim 18 wherein the stop means is configured so that when articulation between the operator members is limited, the operator members are substantially longitudinally aligned with each other, thereby defining an over-center position.

20. The operator of claim 19 wherein the blade of the damper is locked in position when the operator members assume the over-center position.

21. The operator of claim 20 wherein the blade of the damper is locked in a closed position.

22. The operator of claim 1 wherein articulation of the operator members causes rotation of the damper blade between an open and a closed position, and wherein the operator members are capable of assuming at least one over-center position in which the operator members are substantially longitudinally aligned with each other, thereby locking the blade of the damper in position.

23. The operator of claim 22 wherein the over-center position occurs when the damper blade is fully open.

24. The operator of claim 22 wherein the over-center position occurs when the damper blade is fully closed.

25. The operator of claim 1 wherein portions of the operator members extend externally of the damper frame.

26. The operator of claim 1 wherein the actuator means includes a rotatable shaft engaging a portion of the first operator member which is operatively associated with the damper frame, and wherein articulation of the operator members develops a substantially linear relationship between rotation of the shaft and changes in air flow through the damper.

27. The operator of claim 1 wherein the substantially direct relationship developed is a substantially linear relationship.

28. The operator of claim 1 wherein the blade rotates within the frame about a pivot located at or between longitudinal edges of the damper blade.

29. An apparatus comprising:

(a) a damper having a frame and at least one blade adapted for rotation within the frame between an open position and a closed position; and (b) an operator for operating the damper comprising:

(i) at least two, pivotally interconnected operator members, a first operator member being operatively associated with the frame of the damper and a second operator member being operatively associated with the damper blade; and (ii) actuator means operatively associated with at least one of the two operator members;

wherein operation of the actuator means causes articulation of the operator members, which in turn causes rotation of the damper blade, so that the amount of operation of the actuator means increases as the damper blade moves toward the open position.

* * * * *